US007325556B2

(12) United States Patent
Walter

(10) Patent No.: US 7,325,556 B2
(45) Date of Patent: Feb. 5, 2008

(54) TRANSPARENT COMBINATION PACKAGE FOR CLEANING, SPIN DRYING, DISPLAYING AND STORING A PAINT ROLLER

(75) Inventor: William Robert Walter, Baker City, OR (US)

(73) Assignee: Walter Trust, Baker City, OR (US), Trustee: William R. Walter; Evelyn Joyce Walter ( * ) Notice: Subject to any disclaimer, the term of this patent is extended or adjusted under 35 U.S.C. 154(b) by 547 days.

(21) Appl. No.: 10/934,032

(22) Filed: Sep. 3, 2004

(65) Prior Publication Data

US 2006/0048804 A1 Mar. 9, 2006

(51) Int. Cl.
*B08B 3/02* (2006.01)

(52) U.S. Cl. ..... 134/138; 134/900

(58) Field of Classification Search ..... 134/900, 134/138

See application file for complete search history.

(56) References Cited

U.S. PATENT DOCUMENTS

| | | | | |
|---|---|---|---|---|
| 3,075,534 | A | 1/1963 | Habostad | |
| 3,577,280 | A | 5/1971 | George | |
| 3,688,785 | A | 9/1972 | Stevens et al. | |
| 3,837,091 | A | 9/1974 | Meyer | |
| 3,897,797 | A | 8/1975 | Wright et al. | |
| 4,108,189 | A | 8/1978 | Claiborne | |
| 4,126,484 | A | 11/1978 | Monteiro | |
| 4,130,124 | A | 12/1978 | Sherwin | |
| 4,142,540 | A | 3/1979 | Vegiard | |
| 4,155,230 | A | 5/1979 | Lacher, Jr. | |
| 4,172,373 | A | 10/1979 | Lary | |
| 4,200,949 | A | 5/1980 | Heniff, Jr. | |
| 4,237,575 | A | 12/1980 | Mlachnik | |
| 4,311,158 | A | 1/1982 | Harvey | |
| 4,446,590 | A | 5/1984 | Kirchner et al. | |
| 4,569,099 | A | 2/1986 | Harding | |
| 4,606,777 | A | 8/1986 | Brow | |
| 4,641,673 | A | 2/1987 | Conley et al. | |
| 4,667,361 | A | 5/1987 | Wolcott et al. | |
| 4,672,987 | A | 6/1987 | Brandt | |
| 4,708,152 | A | 11/1987 | Hibberd | |
| 4,733,679 | A | 3/1988 | Dolcater | |
| 4,735,221 | A | 4/1988 | Vegiard | |
| 4,765,354 | A | 8/1988 | Thatcher et al. | |
| 4,809,722 | A | 3/1989 | Pennise | |
| 5,005,598 | A * | 4/1991 | Hodgdon | 134/138 |
| 5,050,626 | A | 9/1991 | Brockage | |
| 5,095,928 | A | 3/1992 | Phipps | |
| 5,185,938 | A | 2/1993 | Hutt | |

(Continued)

*Primary Examiner*—Michael Barr
*Assistant Examiner*—Jason Heckert

(57) ABSTRACT

This invention has two components, a side delivery spray wand and a transparent plastic package with two compartments. One compartment serves for storage and display of the spray wand, and for guiding and limiting the wand's use in delivering the spray to the paint roller surface. The other compartment serves for storage and display of a paint roller, and is the protective chamber within which a roller is cleaned and spin-dried. The enclosure possesses a small top opening for insertion of the spray wand, and a bottom opening for rapid exhaust of paint-laden solvent. Its two halves are hinged, book-like. When open multiple units nest conveniently. When closed, the compartments are completed, a segment of a paint roller handle is captured, and the seam seals to force all of the paint laden solvent to vent at the exit port.

6 Claims, 8 Drawing Sheets

U.S. PATENT DOCUMENTS 5,238,012 A * 8/1993 Coronato ..... 134/140
5,322,081 A 6/1994 Isaac
5,402,808 A 4/1995 Wallis
5,413,133 A 5/1995 Russell
5,452,734 A 9/1995 Steeves
5,487,399 A 1/1996 Hannah
5,505,220 A 4/1996 Gorecki
5,544,668 A 8/1996 Dollar
5,614,021 A 3/1997 Catlin
5,626,158 A 5/1997 Gratopp
5,645,091 A 7/1997 Hoeft
5,797,410 A * 8/1998 Gates ..... 134/138
6,116,255 A * 9/2000 Walter ..... 134/138

* cited by examiner 5
2

7
6
2
7
6

TRANSPARENT COMBINATION PACKAGE FOR CLEANING, SPIN DRYING, DISPLAYING AND STORING A PAINT ROLLER

RELATED APPLICATIONS

This disclosure covers the design, construction, and use of a clear plastic package, herein termed the "the transparent combination package" which replaces the handled cone element of the PAINT ROLLER AND SPIN DRYER described in U.S. Pat. No. 6,116,255, and incorporates and uses an adaptation of the spray wand element described and protected by that US patent, invented and filed by this same inventor, William R. Walter on May 4, 1998 (application Ser. No. 09/072,072). The "transparent combination package" herein disclosed is a truly novel device, unanticipated in the prior invention, and which possesses features and improvements that enhance its manufacturability, marketability and utility over every patented device reviewed. It was the quest for improving the performance and reducing the production cost of the protective enclosure element of that prior invention, which led to an adaptation of the design to fit a manufacturing process termed "In-line vacuforming". This adapted design yielded unanticipated, novel and useful features. In addition to the cleaning and spin drying capabilities sought, the resulting package possessed features commending it to serve as a package for the display and storage of paint rollers as well. These features of this design suggested the use of the name "A Transparent Combination Package for cleaning, spin drying, displaying and storing a PAINT ROLLER", and are deemed to qualify this disclosure as new and novel.

STATEMENT REGARDING FEDERALLY SPONSERED RESEARCH

N/A

REFERENCE TO SEQUENCE LISTING, ETC

N/A

BACKGROUND OF THE INVENTION

1. Field of the Invention

This invention relates to paint roller cleaners, specifically to such cleaners that use water or other solvents and centrifugal action to clean paint rollers.

2. Description of Prior Art

Although four score or more patents of this genre have been issued within the past two decades, paint specialty and general merchandise stores rarely offer any selection. Not one of the 26 patented devices reviewed in depth possesses all of the features herein deemed essential. Such a device must be easy to use, durable, inexpensive and require no maintenance. It must shield the operator and cleaning area from paint and solvent splatter. It must render the roller ready for immediate reuse or storage. It must accommodate the full variety of common paint rollers, and perform its function without having to remove the roller from its handle.

Eight (8) previously patented devices reviewed require removal of the roller cover prior to installation in the device. U.S. Pat. Nos. 4,155,230; 4,237,575, 4,311,158; 4,708,152; 4,733,679; 5,185,938; 5,452,734; 5,487,399.

Seven (7) patents reviewed have been issued for devices which provide no drying action. U.S. Pat. Nos. 4,126,484; 4,155,230; 4,172,373; 4,606,777; 4,765,354; 5,322,081; 5,452,734.

Eight (8) of the reviewed patented devices wash and spin the paint roller through a "plurality of jets". This attempt to provide "full length cleaning coverage" seriously reduces the penetrating and spinning power available in normal domestic water systems. Likewise, unless the jets are closely spaced, these devices leave poorly cleaned bands on the paint roller. U.S. Pat. Nos. 4,130,124; 4,446,590; 4,708,152; 5,050,626; 5,402,808; 5,505,220; 5,614,021; 5,626,158.

One (1) U.S. Pat. No. 4,108,189 provides a "fan-shaped" discharge of water "contacting the roller throughout its entire length". Being continuous, such a spray action would eliminate the "banded cleaning effect" of the previous eight devices, but it shares the main problem, a serious reduction in penetrating and spinning power by spreading that force over the entire length of the roller.

One (1) U.S. Pat. No. 3,075,534 issued to A. Harbostad in 1963 has some of the above listed essential features. The principal defect of this device is its limited usability. The only paint rollers which will fit the device are those with 90 degree bends in the handle. Most of the paint roller handles on the market would not fit this device, even if it were available. Other defects include enclosed bottom, seriously occluded exhaust which allows accumulation of swirling liquid during spin drying as well as design features adversely effecting manufacturability and cost.

One (1) U.S. Pat. No. 6,116,255 issued to this applicant, William R. Walter in 2000, was earlier deemed to answer all of the deficiencies and drawbacks of previous devices. However, manufacturing and marketing the device yielded evidence of the need for at least three improvements: (1) elimination of even an occasional splatter out of the open top, (2) a design more amenable to mass production and (3) production and distribution cost reductions.

3. Summary of Defects and Disadvantages of Prior Patented Paint Roller Cleaners:

a) Cleaners that feature removal of the roller from the handle prior to cleaning require the operator to handle the paint covered roller. This is time consuming and messy.
b) Devices which leave the finished roller too wet for immediate reuse or for storage.
c) Devices which cannot provide deep cleaning and high speed spin action because the available force of the spray is spread throughout the full length of the roller.
d) Devices that are unable to accommodate the variety of common roller designs.
e) Devices such as my own invention, cited earlier, where the process is not always fully and dependably contained, where further cost reductions can be achieved by design modifications, or where previously unanticipated features can add to its usefulness.

4. Conclusion Drawn from Analysis of Prior Art

A need yet remains for a device which possesses all of the characteristics essential to answer the deficiencies described above.

SUMMARY OF THE INVENTION

Disclosed herein is an apparatus whereby a paint roller can quickly be cleaned, fluffed, and rendered damp-dry, with the operator and cleaning area completely shielded from the splatter of solvent and paint. The washing and spin-drying actions are produced by a high velocity single jet of water, or other solvent, delivered through a hand-held spray wand within the confines of a clear plastic enclosure. This enclosure envelops the roller whether for display, cleaning, spin-drying, or storage. The enclosure possesses a small top-opening for insertion of the side delivery spray wand, and a bottom-opening for rapid exhaust of paint-laden solvent, and is sealed along the seams where the two halves of the closed package join to force all of the paint laden solvent to vent at the designed exit port. The enclosure mates with a segment of a paint roller frame in such a way that the roller handle protrudes, permitting the operator to hold the roller, with the transparent combination package firmly attached, in the hand of choice, and to manipulate the spray wand with the other hand.

DETAILED DESCRIPTION OF THE INVENTION

A Transparent Combination Package for Cleaning, Spin Drying, Displaying, and Storing a PAINT ROLLER Disclosed herein is a device with four discrete functions relating to paint applicator tools known as paint rollers: first, it serves as a display package for a fully assembled paint roller; second, it functions as a cleaning or washing device for a paint roller; third, it functions as a spin-drying device for a paint roller; and finally, it serves as a storage package both for the device and for a paint roller.

This device has two components, a spray wand and a package or compartmented enclosure. One compartment of the package is designed to accommodate the spray wand for use, display and storage. A second compartment of the package is designed for containment of the processes of cleaning and spin drying, as well as for the display and storage of the paint roller.

The spray wand is a tubular device possessing a connection end and a spray delivery end. For use, the wand is removed from its compartment, connected to a high pressure cleaning fluid source, typically cold water, and re-inserted into the same compartment to deliver a high velocity jet of fluid perpendicular to the wand axis in order to serve both the cleaning and spin drying functions.

The package possesses four major features: transparency, handle indexing channels, a roller chamber, and a spray wand channel. Minor features of the package include a keyed wand insertion opening, roller handle exit ports, a fluid exhaust port, hinge, fasteners, fluid seals, opening tabs, holes for hanging, and spaces for information such as advertising and instructions. All of the features of the package are provided for by the material selected for its construction and by the formation of those materials.

Transparency is an essential feature for the device to function as a display package and useful in its other functions. The handle indexing channels serve to hold a paint roller handle firmly in such a fashion that an attached roller is free to rotate within the roller chamber. The spray wand channel is aligned alongside the roller chamber with open communication along the full length of both, providing a spray pathway from the wand channel into the roller chamber, and designed so as to limit the spray wand's range of rotation and prevent its inadvertent withdrawal. The roller chamber when closed is cylindrical in shape, with space at both ends and within its circumference to allow an enclosed roller to spin freely. The chamber is sealed to contain the cleaning process, to collect all the paint-laden solvents and to deliver them through the exhaust port into an appropriate receptacle.

When the device is used as a display package the side-delivery spray wand appears in the spray wand channel side by side with a paint roller installed in the roller chamber. When used as a cleaning device and as a spin/drying device the spray wand is removed from its channel, its connection end is attached to a hand control valve supplied with a source of solvent under pressure, and its spray delivery end is inserted through the keyed insertion opening into the spray wand channel for the delivery of a high velocity jet of solvent to serve the cleaning and spin drying processes. The package has continued usefulness as a permanent storage receptacle for the spray wand and for the paint roller with its installed cover, available for reuse again and again.

This combination package can be thought of as a simple enclosure formed from a single sheet of clear plastic, having front and back halves, which are hinged, book like, to form the complete unit. When open flat, numerous enclosure units may be stacked for efficient quantity packaging. Its simplicity and low unit cost commend it for adaptation to fit nearly any conceivable style or size of paint roller.

The package is very light and is firmly supported by the paint roller handle frame to which it is affixed by the indexing channels. Thus installed the handle of the paint roller protrudes from the package permitting the operator to grasp it with the hand of choice as when applying paint, leaving the other hand free to manipulate the side delivery spray wand as needed to deliver a jet of solvent to the paint laden roller fibers in the cleaning and spin drying process.

BRIEF DESCRIPTION OF THE DRAWINGS

A Transparent Combination Package for Cleaning, Spin Drying, Displaying, and Storing a PAINT ROLLER

REFERENCES TO SPECIAL FEATURES OF DRAWINGS

A Transparent Combination Package for Cleaning, Spin Drying, Displaying, and Storing a PAINT ROLLER

1—transparent combination package
2—spray wand
3—spray wand channel

Figure 1:
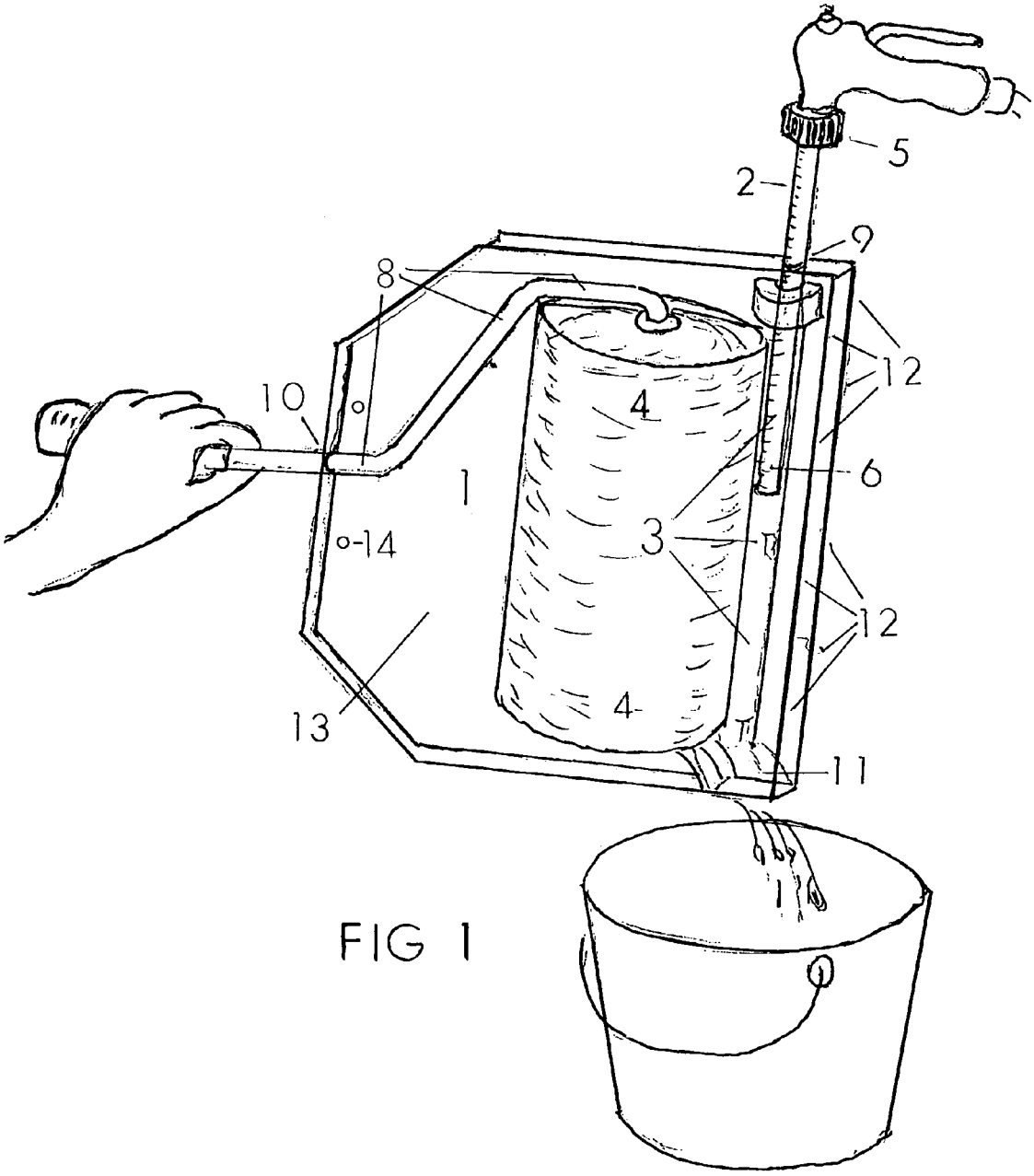
FIG. 1 is a perspective view of the transparent Combination Package with installed paint roller undergoing the cleaning/spin-drying process. (Suggested for cover)
Figure 2:
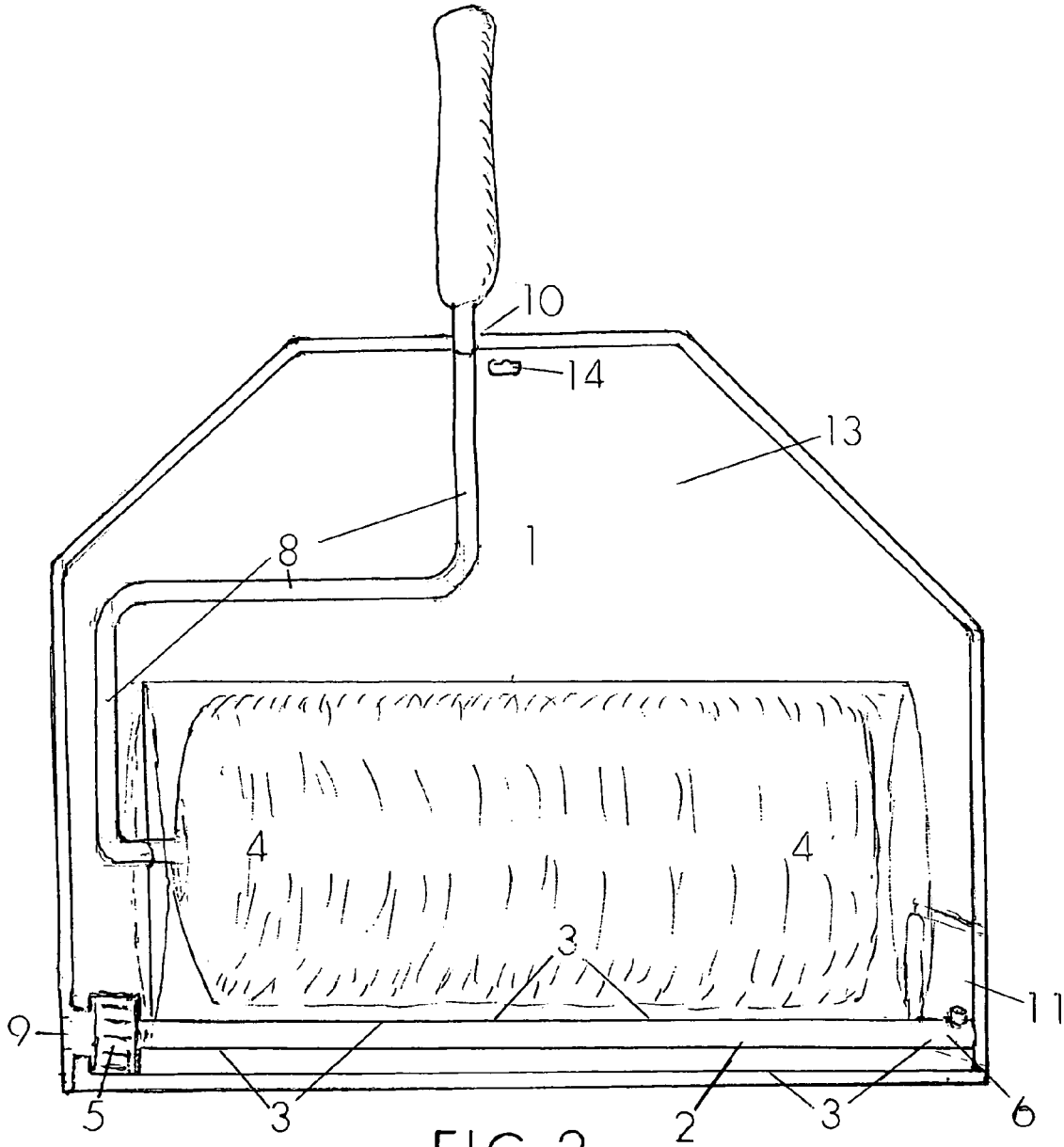
FIG. 2 is a front view of the transparent Combination Package with paint roller and spray wand installed, illustrating a typical display.
Figure 2A:
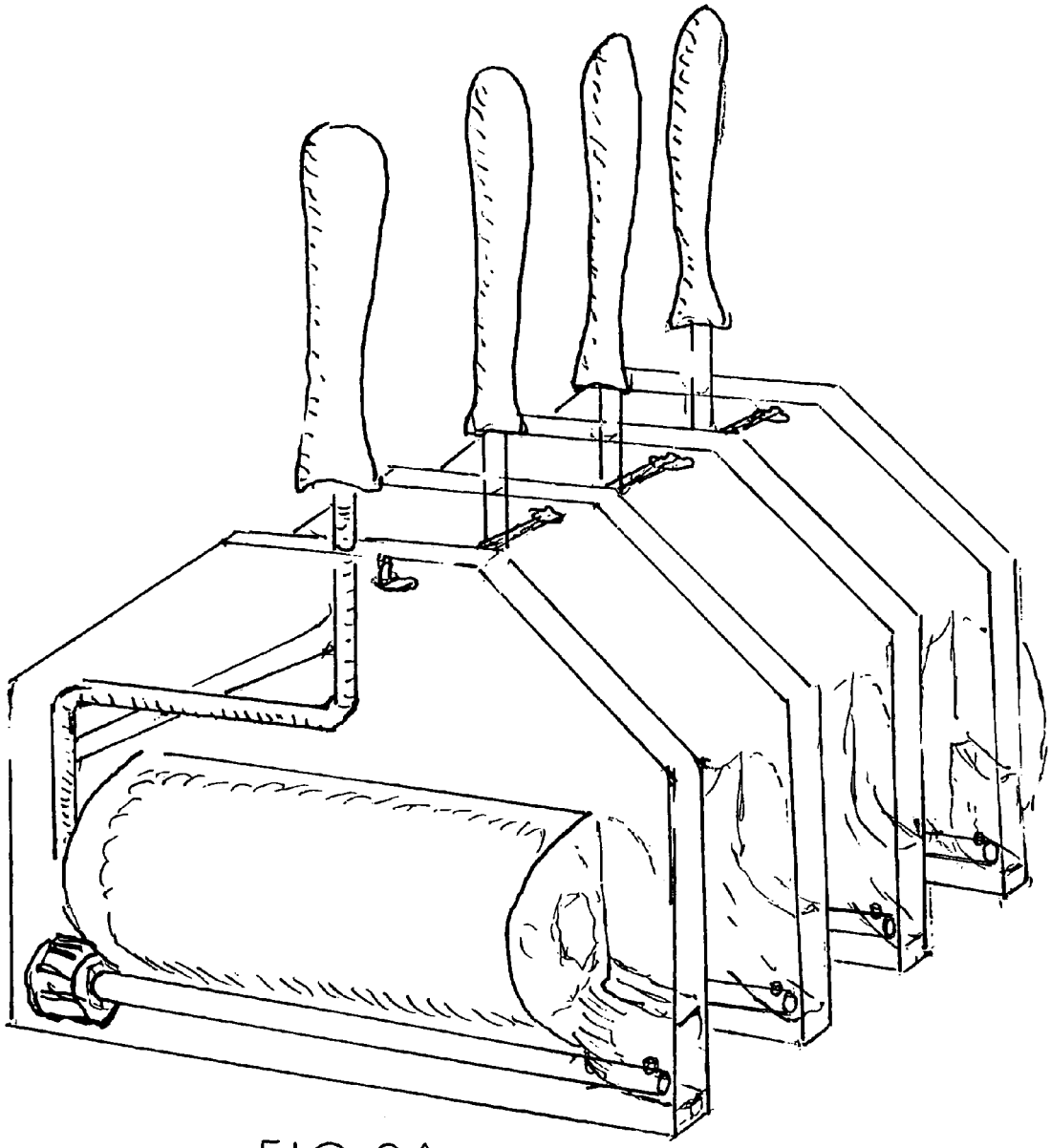
FIG. 2A is a perspective view to illustrate a typical display of several Transparent Combination Package units, each with an enclosed paint roller and spray wand.
Figures 3, 3A, 3B:
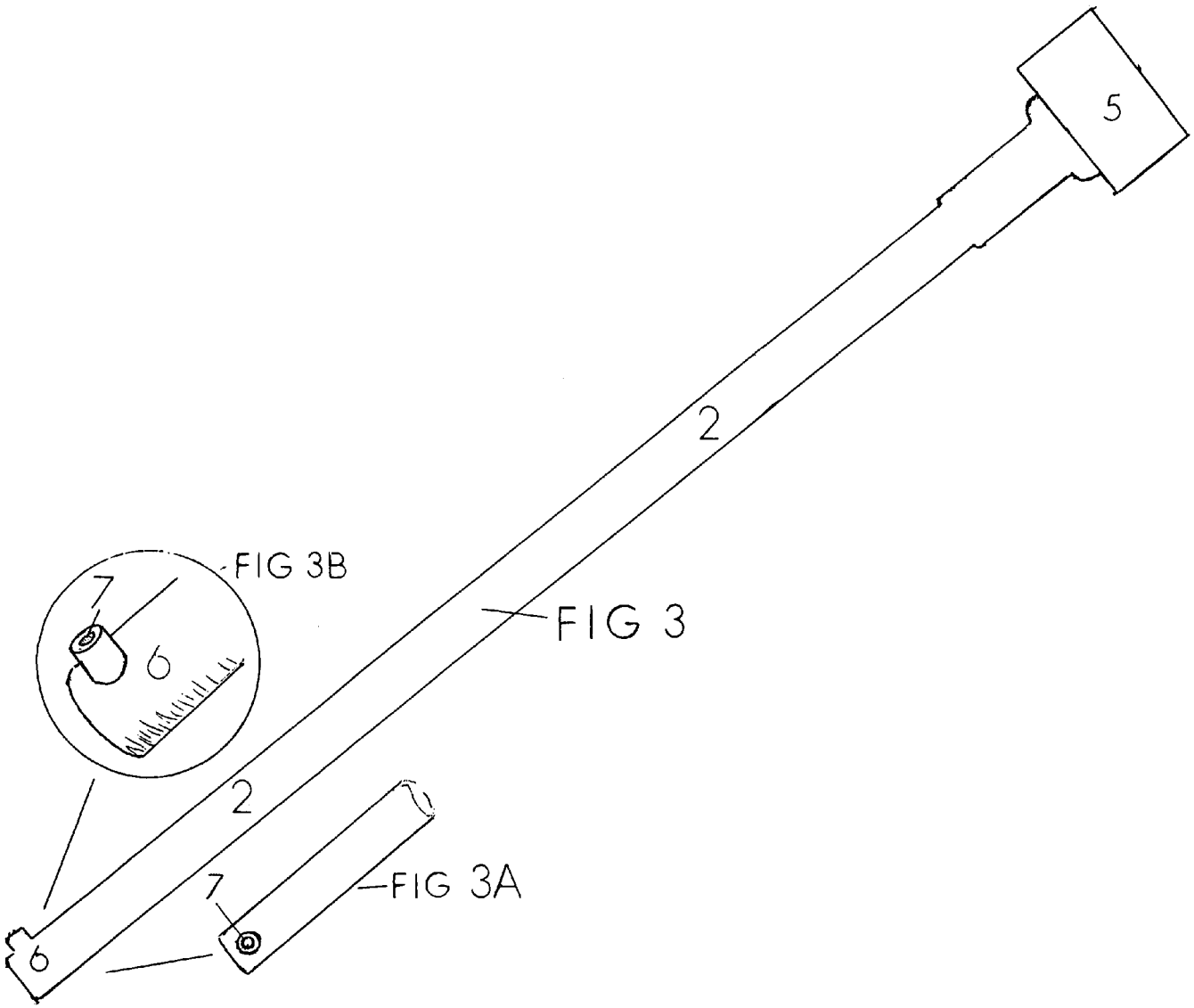
FIG. 3 is a side view of a typical spray wand.
FIG. 3A is a spray wand delivery end rotated 90 degrees.
FIG. 3B is a spray wand delivery end enlarged and rotated 45 degrees
Figure 4:
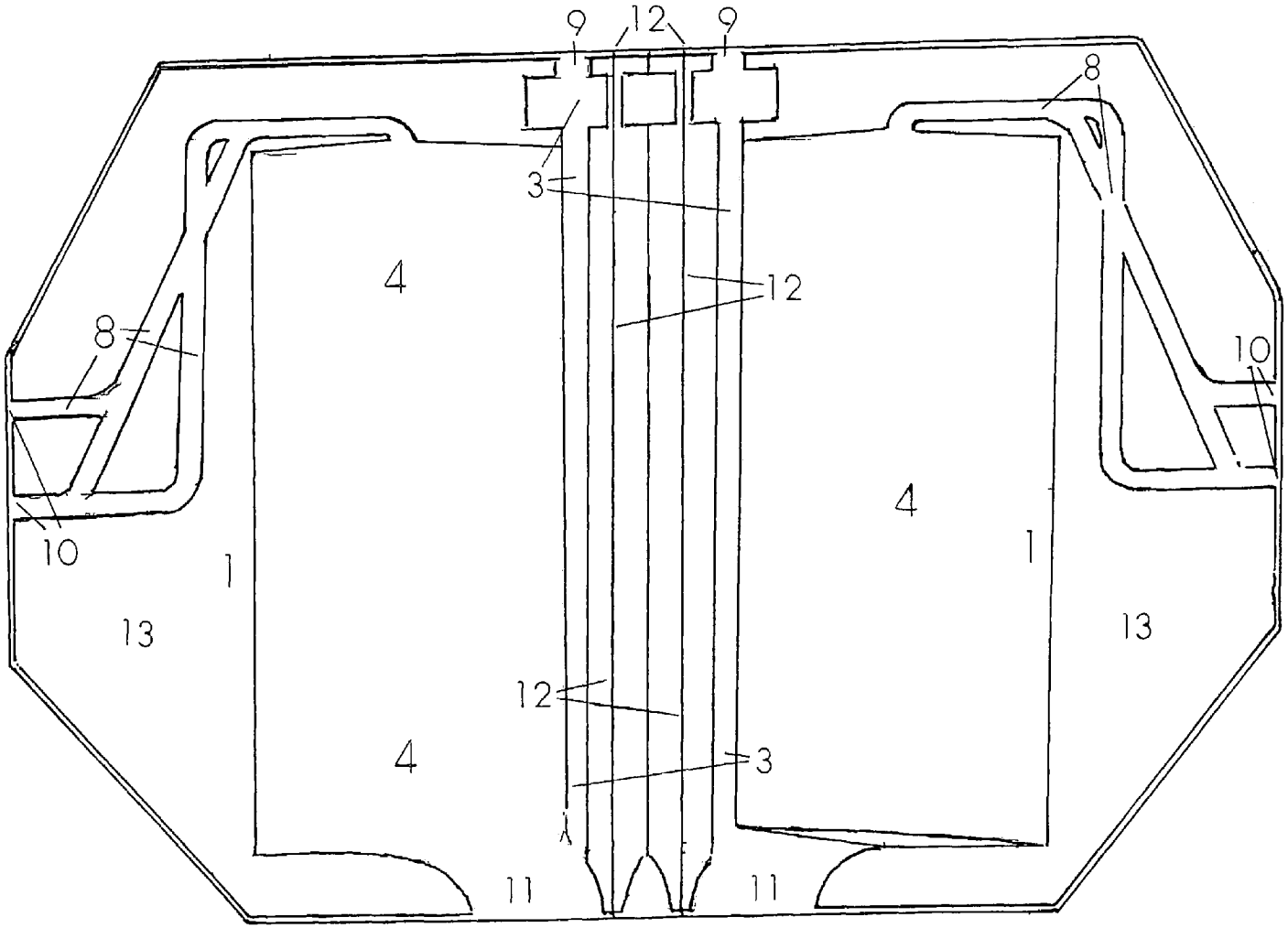
FIG. 4 is a top plan view of a Transparent Combination Package shown flat (open).
Figure 4A:
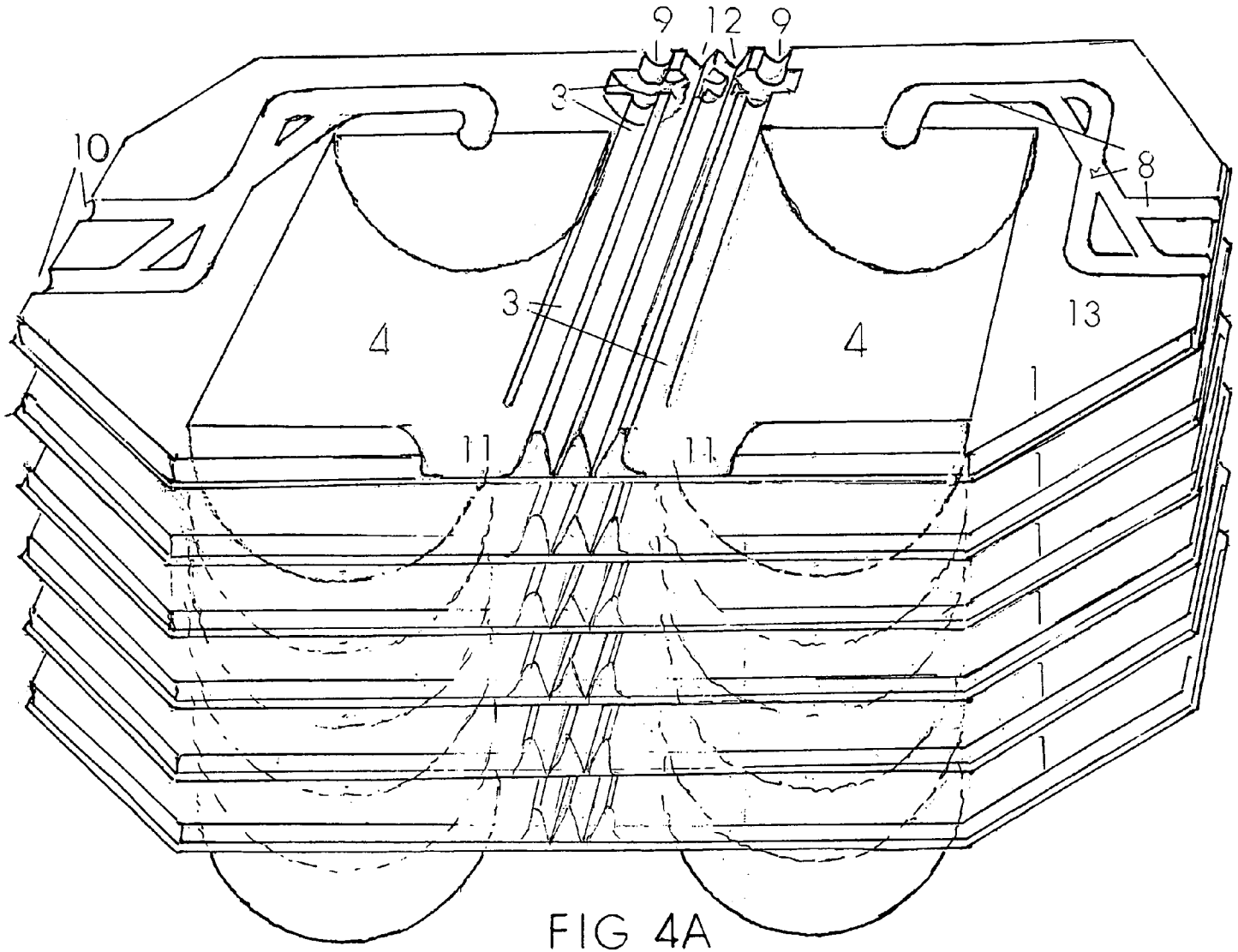
FIG. 4A is a perspective view of a stack of transparent combination Packages illustrating nesting.
Figure 5:
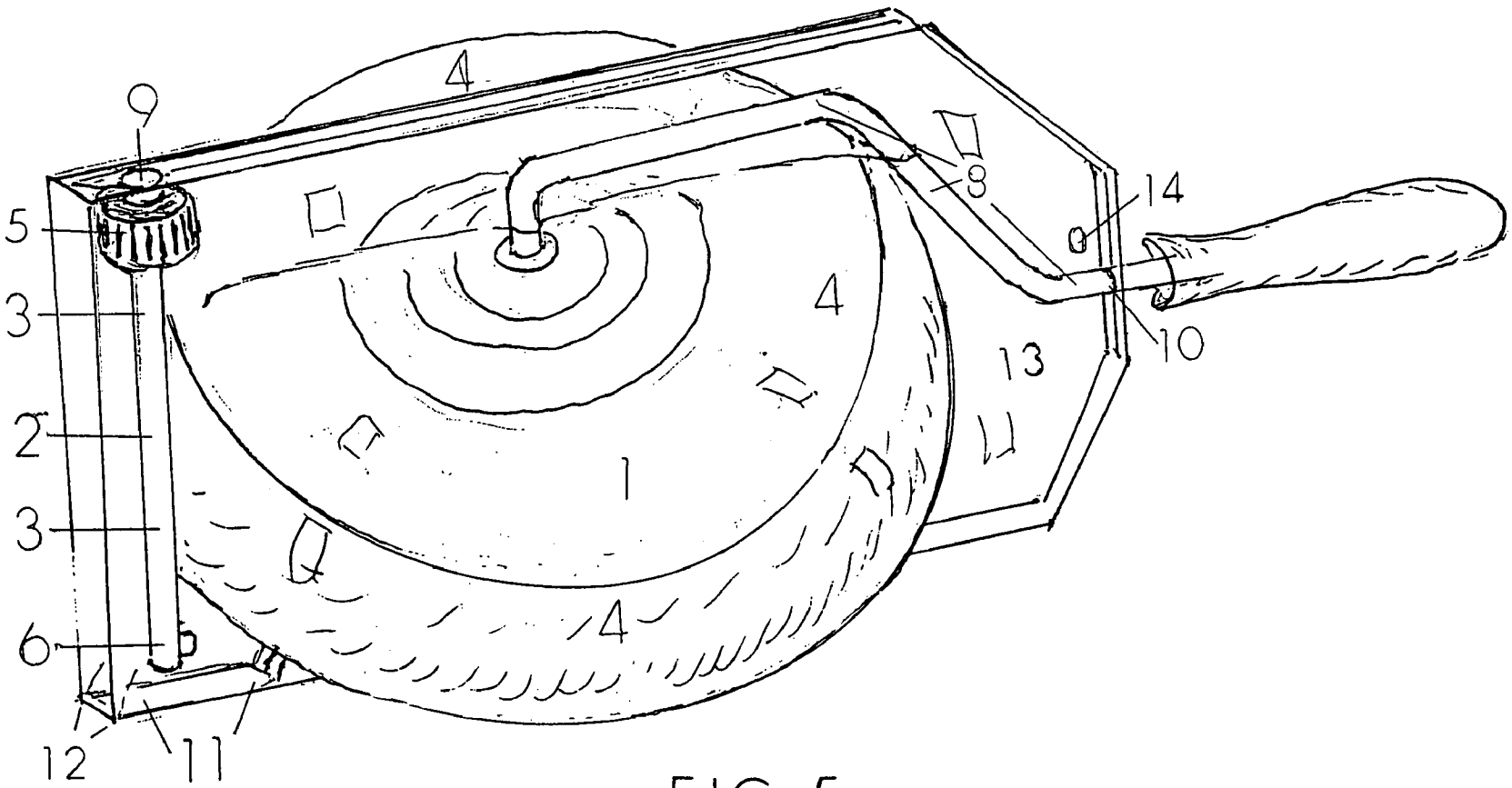
FIG. 5 is a perspective view of a Transparent Combination Package designed for a specialty paint roller which is displayed therein along with spray wand for sale or storage
Figure 5A:
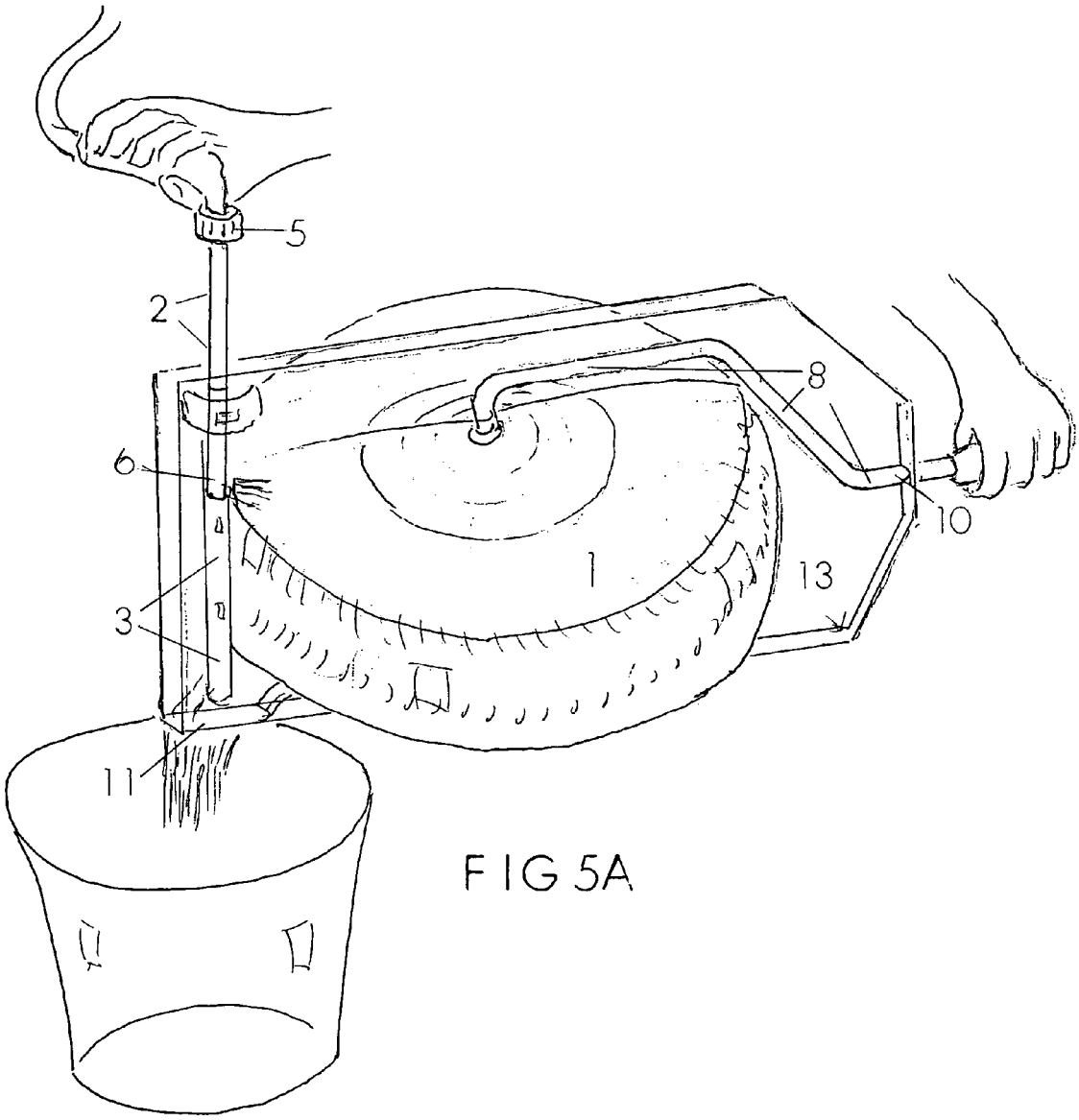
FIG. 5A is a perspective view of a transparent Combination Package designed for a specialty roller illustrating the cleaning/spin-drying process.

4—roller chamber (cleaning chamber)
5—connection end of spray wand
6—spray delivery end of spray wand
7—spray orifice
8—handle indexing channels
9—wand insertion opening
10—roller handle exit port(s)
11—fluid exhaust port
12—hinge
13—space for inserting informative art
14—holes for hanging Use of the Device with References to the Drawings 1. Used as a Display Package Hanging holes 14 are provided permitting efficient arrangement of a number of units offered for sale. A painter might be attracted to a display such as is represented in FIGS. 2 and 2A and FIG. 5, and by graphics installed in the space provided 13.

2. Used for Cleaning a Paint Roller a. Set Up

After completing the painting, the painter returns the paint-laden roller 4 to its place in the package 10, removes the spray wand 2, closes the package 1, and secures the holding devices (not represented). The connection end 5 of the spray wand 2 is attached to any standard male hose connector supplied with solvent, preferably cold water, the supply being under operator control as with the commonly used pistol grip hand control valve. The operator inserts the delivery end 6 of the spray wand 2 into the spray wand channel 3 where a strong jet of solvent is released and directed toward the paint laden roller fibers. The spray is completely contained within the transparent combination package thus protecting the operator and the cleaning area from paint and solvent splatters.

b. Soak Mode

Typically the process begins with the jet of solvent being directed perpendicularly toward the center axis of the paint roller where the jet's power penetrates the fibers most effectively without inducing roller rotation. The spray wand is gradually inserted fully into the channel to soak the roller from end to end; and then, by directing the jet slightly to one side of roller center rotation will begin to occur. With a slow rate of roller rotation established, repeated movement of the spray wand out and in permits the complete surface of the roller to become saturated with solvent.

c. Spin Mode

A rapid spinning of the paint roller is induced by simply directing the full power of the jet of solvent toward the outer perimeter of the roller. If the spin mode is entered with the roller surface incompletely saturated with solvent the unbalanced condition of the roller will result in momentary wobbling until balance is achieved through the off-throwing of paint laden solvent and near dryness occurs. Spin mode can be entered gradually or abruptly as the operator chooses and is determined by the angle at which the jet of spray is caused to impinge upon the roller surface.

d. Thorough Cleaning

Repeating the soak cycle and the spin cycle a few times may be necessary to assure that all of the paint residue has been removed from the roller pile. Most paint rollers can be rendered damp dry and ready for immediate reuse by continuing the spin cycle until maximum rotational velocity occurs, and then by ending the process by abruptly shutting off the water supply to the spray wand during that moment of maximum rotational velocity. The more rapid the rotation, the more effective the drying action will be, and the longer the duration of high velocity spin after the spray is terminated the more effective the drying action will be.

e. Residue Removal

During the spin process the off-thrown solvent collects on the inner surface of the roller chamber and flows downward in a swirling motion toward the fluid exit port 11. The bottom surface of the roller chamber 4 is designed to deliver the fluid through the exit port 11 for rapid and complete removal of all solvent and paint residue. The exit port 11 is designed to concentrate the waste liquids for delivery as a single stream into any appropriate collection device.

3. Used for Storage

Preparation for long term storage should include opening the package to place the spray wand in its channel and to allow the damp roller fibers to dry thoroughly. The package is then closed, fastened, and placed where heavy objects are unlikely to crush it. Hanging holes 14 are provided to permit the device to be hung on a convenient nail or hook.

I claim:

1. A container for cleaning, spin drying, displaying, and storing a paint roller, said container is formed from a single sheet of transparent plastic, nesting uniformly with other like sheets of formed transparent plastic; said container folds along a hinge in the form of parallel crease lines to close said container and complete its primary features, half of each feature having been impressed into each half of said formed plastic sheet; said container when closed possesses a roller chamber, of a length and diameter as are required to enclose a roller segment of a paint roller, and a wand chamber, of a length and diameter as are required to enclose a spray wand; said roller chamber and said wand chamber possess in common an open channel connecting adjacent sides of said two chambers, said open channel serves as straight guides and rotational limits for a spray end of a side delivery spray wand to deliver a spray from said wand chamber into said roller chamber for the purposes of cleaning and spin drying a paint roller; said container possesses a fluid seal which mates when said container is closed to prevent liquid passage, and fastening means to hold said container closed; said container has a top or upper side and a bottom or a lower side with said channels oriented vertically, said container possesses an opening located directly above said wand channel, said opening being in open communication with said wand channel, said opening is shaped appropriately for insertion of a spray end of a spray wand and to prevent inadvertent removal of a spray end during spray activation, said opening is shaped to retain a spray wand installed for display or storage; said container also possesses an opening herein termed the exhaust, said exhaust being located directly below said wand channel, said exhaust being shaped for rapid elimination of liquids from said wand chamber and said roller chamber; said roller chamber being cylindrically shaped possesses both an upper end and a lower end; said upper end of said roller chamber is sealed with aforementioned fluid seal with the exception of a centrally located opening in said upper end for a shaft of a paint roller; said lower end of said roller chamber is completely enclosed, said lower end of said roller chamber is sealed with aforementioned fluid seal, said lower end of said roller chamber is formed to slope uniformly toward said exhaust so as to rapidly channel all accumulating liquids from said container out through said exhaust; said container also possesses means to capture and hold a handle of a paint roller in such a fashion that a paint roller is suspended within said roller chamber retaining an ability to rotate freely on its own shaft with no other attachments or means of support than that afforded by shapes formed in the plastic material.

2. A container according to claim 1, designed to contain wholly or in part a paint roller handle with a paint applicator sleeve installed, said container is shaped and molded to possess features and compartments wherein said compartments are capable of receiving marketing devices.

3. A container according to claims 1 or 2, possessing a shaped opening for insertion of a spray wand nozzle, said shaped opening of said container is formed in such a fashion as to require a nozzle of a spray wand to be rotated to one of two certain positions to permit either insertion or withdrawal of a spray wand nozzle.

4. A container according to any of claims 1, 2, or 3 wherein certain features impressed on each half of the of the single transparent sheet, divided by the hinge, are formed to possess the kind of symmetry required to foster use either handedly.

5. A container according to any of claims 1, 2, 3, or 4, wherein said nozzle features a protruding spray orifice, wherein said protruding spray orifice corresponds to said shaped opening and is a physical means to require rotation to a certain position for insertion or withdrawal of said nozzle through a shaped opening, and is a physical means to limit an angle of delivery for an activated spray.

6. A container according to any of claims 1, 2, 3, 4, or 5, wherein one or more holes for hanging are provided, said holes being shaped and arranged to support and foster displaying the package and its contents in a variety of orientations.

* * * * *